US009697968B2

(12) United States Patent
Rival et al.

(10) Patent No.: US 9,697,968 B2
(45) Date of Patent: Jul. 4, 2017

(54) ELECTRICAL CIRCUIT BREAKER

(71) Applicant: Schneider Electric Industries SAS, Rueil Malmaison (FR)

(72) Inventors: Marc Rival, Saint Ismier (FR); Hubert Roelandt, Vif (FR); Stephane Dye, Vatilieux (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 15/208,770

(22) Filed: Jul. 13, 2016

(65) Prior Publication Data

US 2017/0053758 A1 Feb. 23, 2017

(30) Foreign Application Priority Data

Aug. 18, 2015 (FR) ..... 15 57782

(51) Int. Cl.
*H01H 33/20* (2006.01)
*H01H 33/08* (2006.01)

(52) U.S. Cl.
CPC ..... *H01H 33/20* (2013.01); *H01H 33/08* (2013.01)

(58) Field of Classification Search
CPC ..... H01H 9/342; H01H 9/36; H01H 33/08; H01H 9/443; H01H 33/53; H01H 33/596;
(Continued)

(56) References Cited

U.S. PATENT DOCUMENTS 3,997,746 A * 12/1976 Harper ..... H01H 73/18 218/149
4,325,041 A * 4/1982 Murai ..... H01H 71/04 335/16

(Continued)

FOREIGN PATENT DOCUMENTS

FR 2 905 797 A1 3/2008
JP 2006-19113 1/2006

(Continued)

OTHER PUBLICATIONS

French Preliminary Search Report issued Jan. 18, 2016 in French Application 15 57782, filed on Aug. 18, 2015 ( with English Translation of Categories of Cited Documents).

*Primary Examiner* — Truc Nguyen
(74) *Attorney, Agent, or Firm* — Oblon, McClelland, Maier & Neustadt, L.L.P.

(57) ABSTRACT

This electrical circuit breaker includes at least one first fixed land, a support assembly equipped with at least one second land rotationally mobile, about a main axis, between a first position in which the second land is in contact with the first land and a second position in which the second land is separated from the first land and an arc-extinguishing chamber including a stacking of plates, a top arc-guiding horn, a bottom arc-guiding horn, equipped with at least one tab and a screen made of insulating material surrounding the bottom arc-guiding horn. The circuit breaker also includes two protuberances produced in a gas-producing material, which are mounted on the screen, arranged between the bottom horn and the top arc-guiding horn and facing the tab of the bottom arc-guiding horn, the protuberances having a prismatic or pseudo-prismatic form.

10 Claims, 5 Drawing Sheets

(58) Field of Classification Search
CPC ..... H01H 73/18; H01H 9/34; H01H 33/38; H01H 1/20; H01H 33/64; H01H 33/7015; H01H 33/91; H01H 50/546; H01H 1/385
See application file for complete search history.

(56) References Cited

U.S. PATENT DOCUMENTS 4,650,938 A * 3/1987 Genba ..... H01H 9/34 218/149
4,743,720 A * 5/1988 Takeuchi ..... H01H 9/302 218/24
4,877,929 A * 10/1989 Rival ..... H01H 9/36 218/15
5,210,385 A 5/1993 Morel et al.
5,475,193 A 12/1995 Perdoncin
5,841,088 A * 11/1998 Yamaguchi ..... H01H 9/302 218/158
6,172,586 B1 * 1/2001 Ferree ..... H01H 71/08 335/202
6,288,621 B1 9/2001 Rival
6,414,256 B1 * 7/2002 Chen ..... H01H 9/32 218/117
7,034,242 B1 * 4/2006 Shea ..... H01H 9/362 218/149
9,530,592 B1 * 12/2016 Blankemeyer ..... H01H 33/08
2006/0151439 A1 * 7/2006 Shea ..... H01H 9/346 218/149
2008/0067042 A1 * 3/2008 Shea ..... H01H 9/302 200/34
2011/0192822 A1 * 8/2011 Malingowski ..... H01H 9/342 218/157

FOREIGN PATENT DOCUMENTS

JP 2007-280778 10/2007
JP 2008-66155 3/2008

* cited by examiner

ELECTRICAL CIRCUIT BREAKER

The present invention relates to an electrical circuit breaker.

In the field of low-voltage electrical circuit breakers, it is known practice to use an electrical arc-extinguishing chamber equipped with a stacking of metal plates and a pair of bottom and top horns, in order to absorb electrical energy associated with an electrical arc. In particular, upon the switching of an electrical current passing between a fixed contact and a mobile contact of the circuit breaker, the opening of the contacts is generally accompanied by the formation of an electrical arc, called inter-electrode arc, because it is generated between the contacts of the circuit breaker. Thus, the horns are configured to guide the electrical arc towards the interior of the extinguishing chamber, in which the electrical arc is first elongated and successively broken up, using the metal plates. However, the opening of the contacts can also be accompanied by a partial reclosing through mechanical bounce. This promotes a repeat flashover between the contacts without absorption of the electrical energy of the electrical arc in the extinguishing chamber and can lead to circuit breaker switching failure.

In this regard, it is known practice, for example from EP-A-0 306 382, to equip the quenching chamber with a pair of electrical arc guiding cheeks. These cheeks each have a profile which closely follows the form of the metal plates and are configured to switch the electrical arc from a central zone towards a lateral zone of the extinguishing chamber. The electrical arc is thus displaced onto colder surfaces of the circuit breaker, which promotes the extinguishing thereof. However, the guiding cheeks have a large surface area, which can lead to significant pressures, in switching, in the extinguishing chamber. Furthermore, each guiding cheek constitutes a screen between the mobile contact and the steel parts of the circuit breaker.

In this respect, it is also known practice, for example from EP-A-0 410 902, to equip the bottom arc-guiding horn with a lip, or boss, in order to speed up the displacement of the electrical arc along this bottom horn towards the extinguishing chamber. However, this approach cannot avoid the repeat flashover between the contacts upon a partial reclosure.

It is these drawbacks that the invention seeks more particularly to remedy, by proposing a novel electrical circuit breaker which makes it possible to avoid any repeat flashover and not to generate overpressures inside the extinguishing chamber.

To this end, the invention relates to an electrical circuit breaker comprising at least one first fixed land, a support assembly equipped with at least one second land and rotationally mobile, about a main axis, between a first position in which the second land is in contact with the first land and a second position in which the second land is separated from the first land and an arc-extinguishing chamber comprising a stacking of plates, a top arc-guiding horn, a bottom arc-guiding horn, equipped with at least one tab and a screen made of insulating material surrounding the bottom arc-guiding horn. The circuit breaker also comprises two protuberances produced in a gas-producing material, which are mounted on the screen, arranged between the bottom arc-guiding horn and the top arc-guiding horn and facing the tab of the bottom arc-guiding horn, the protuberances having a prismatic or pseudo-prismatic form.

By virtue of the invention, the protuberances make it possible to recentre the electrical arc while cooling it by gas generation. The cooling of the space between the contacts avoids any repeat flashover despite a mechanical bounce of the contact finger. In practice, the space between the contacts has a greater than normal electrical capacity. Furthermore, the protuberances have a reduced size, in order not to adversely affect the switching efficiency of the electrical circuit breaker, and its electrical endurance.

According to advantageous but non-mandatory aspects of the invention, such an electrical circuit breaker comprises one or more of the following features, taken in any technically admissible combination:

- the bottom arc-guiding horn is equipped with two parallel tabs forming an edge and the two protuberances are arranged on either side of the tabs of the bottom arc-guiding horn;
- the protuberances are symmetrical relative to a central plane of the extension chamber;
- at least one protuberance has a height of between 12 and 30 mm, preferably equal to 18 mm, a width of between 18 and 30 mm, preferably equal to 28 mm, and a maximum thickness of between 3 and 13 mm, preferably equal to 11 mm;
- at least one protuberance has a minimum thickness of between 0 and 5 mm, preferably equal to 3 mm;
- the gas-producing material of at least one protuberance is synthetic, notably a glass fibre-filled polyamide, of type 66;
- the top arc-guiding horn comprises at least one orifice for discharging a gas generated by at least one protuberance;
- the support assembly comprises a plurality of second lands, between 4 and 12 thereof, preferably 10;
- the top and bottom arc-guiding horns are made of steel;
- the protuberances form an integral part of the screen.

The invention will be better understood and other advantages thereof will become more clearly apparent in light of the following description of an electrical circuit breaker according to the invention, given purely as a nonlimiting example and with reference to the attached drawings, in which.

Figure 1:
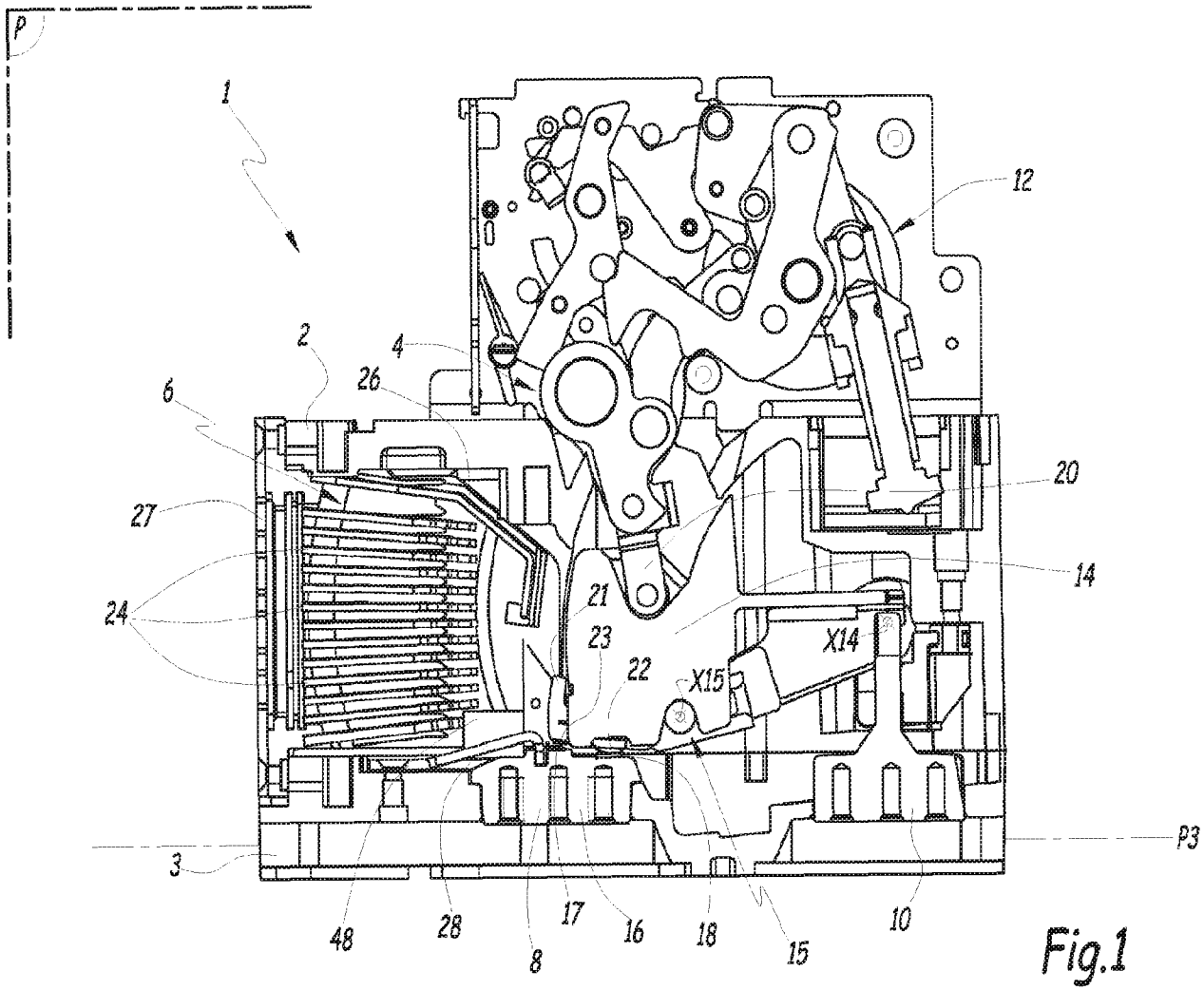
FIG. 1 is a cross section along a plane P of an electrical circuit breaker according to the invention, when the electrical circuit breaker is in a closed position.
Figure 2:
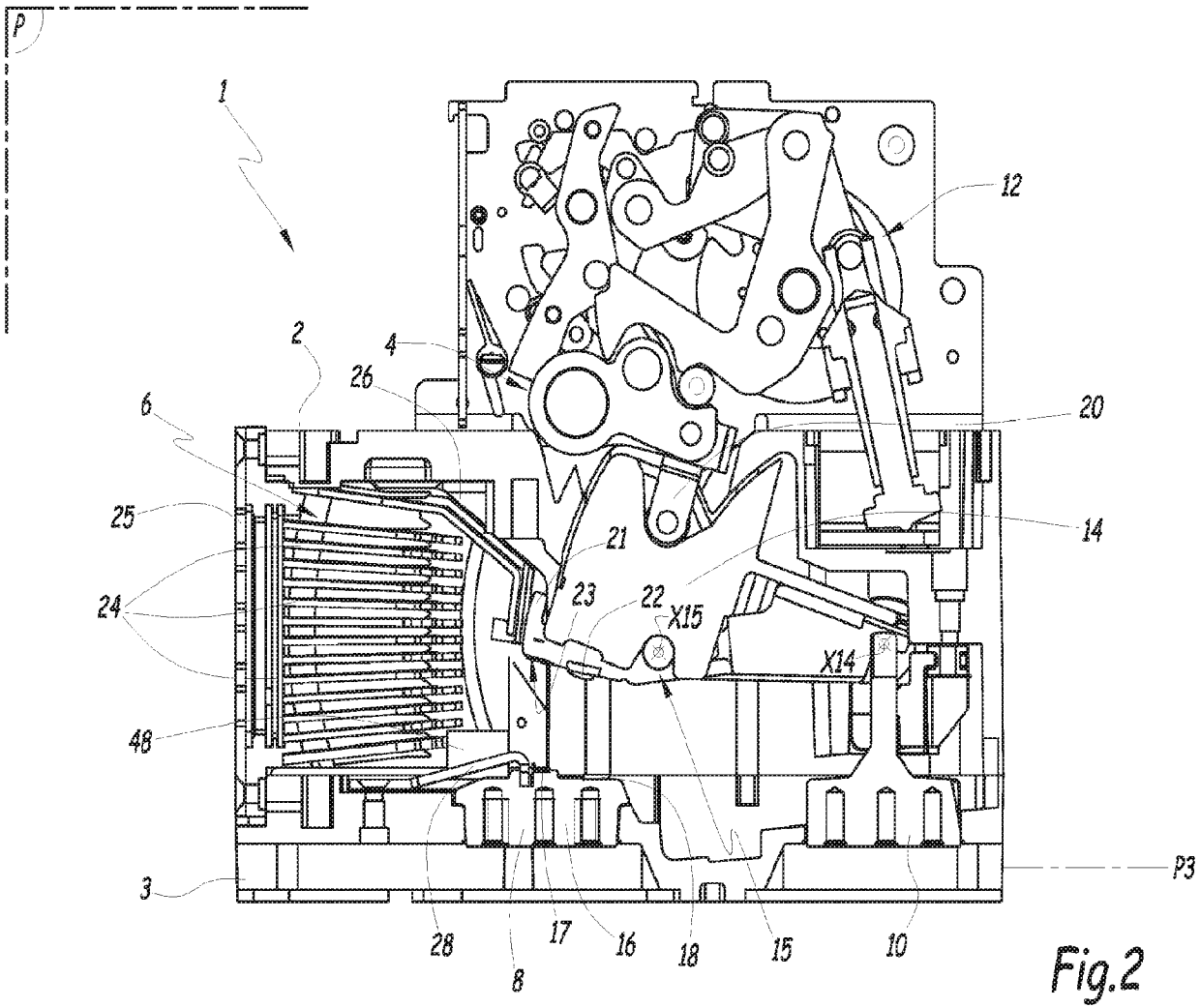
FIG. 2 is a cross section similar to FIG. 1, when the electrical circuit breaker is in an open position.

FIGS. 1 and 2 show an electrical circuit breaker 1. The electrical circuit breaker 1 is configured to stop an electrical current in an electrical circuit. In practice, the electrical circuit breaker 1 is configured to stop all the currents and in particular the short-circuit currents in the electrical circuit. For example, the electrical circuit breaker 1 is a low-voltage high-rating circuit breaker configured to switch a current of intermediate level, for example between 10 and 35 kilo amperes (rms), and an electrical voltage of between, for example, 400 and 700 V.

The electrical circuit breaker 1 comprises an insulating casing 2. The casing 2 comprises a base 3. The base 3 defines a plane P3 of the casing 2. Inside the insulating casing 2, there are arranged a device 4 with separable contacts, an arc-extinguishing chamber 6, a first fixed contact region 8 and a second fixed contact region 10.

The first and second contact regions 8 and 10 are electrical connection contact regions configured to electrically link the electrical circuit with lands of the circuit breaker 1. The first and second contact regions 8 and 10 are fixed onto the base 3 of the casing 2.

The device with separable contacts 4 is configured to open or close the electrical circuit on which the circuit breaker 1 is installed. The device 4 of the electrical circuit breaker 1 comprises a contact mechanism 12, a support assembly 14 and a fixed main contact 16.

The contact mechanism 12 is configured, as is known per se, to displace the support assembly 14 between a first position of closure of the electrical circuit breaker 1 and a second position of opening of the electrical circuit breaker 1. The mechanism 12 is thus capable of displacing the support assembly 14 between its first position and its second position using an arm 20 and based on an electromagnetic and/or mechanical control. The contact mechanism 12 comprises, among other items, a spring device.

For this, the circuit breaker 1 comprises an electromagnetic actuator and a mechanical actuator, which are not represented in the figures.

The electromagnetic actuator comprises a core, a coil and a system of cams. In practice, when the electrical circuit is passed through by an overload current or a short-circuit current, the electromagnetic actuator transmits a command to open the circuit breaker 1 to the contact mechanism 12.

The mechanical actuator comprises a lever that can be displaced between a high position and a low position by a user. Thus, when the user wants to bring about the closure or the opening of the circuit breaker 1, the mechanical actuator transmits a command to the contact mechanism 12.

Figure 3:
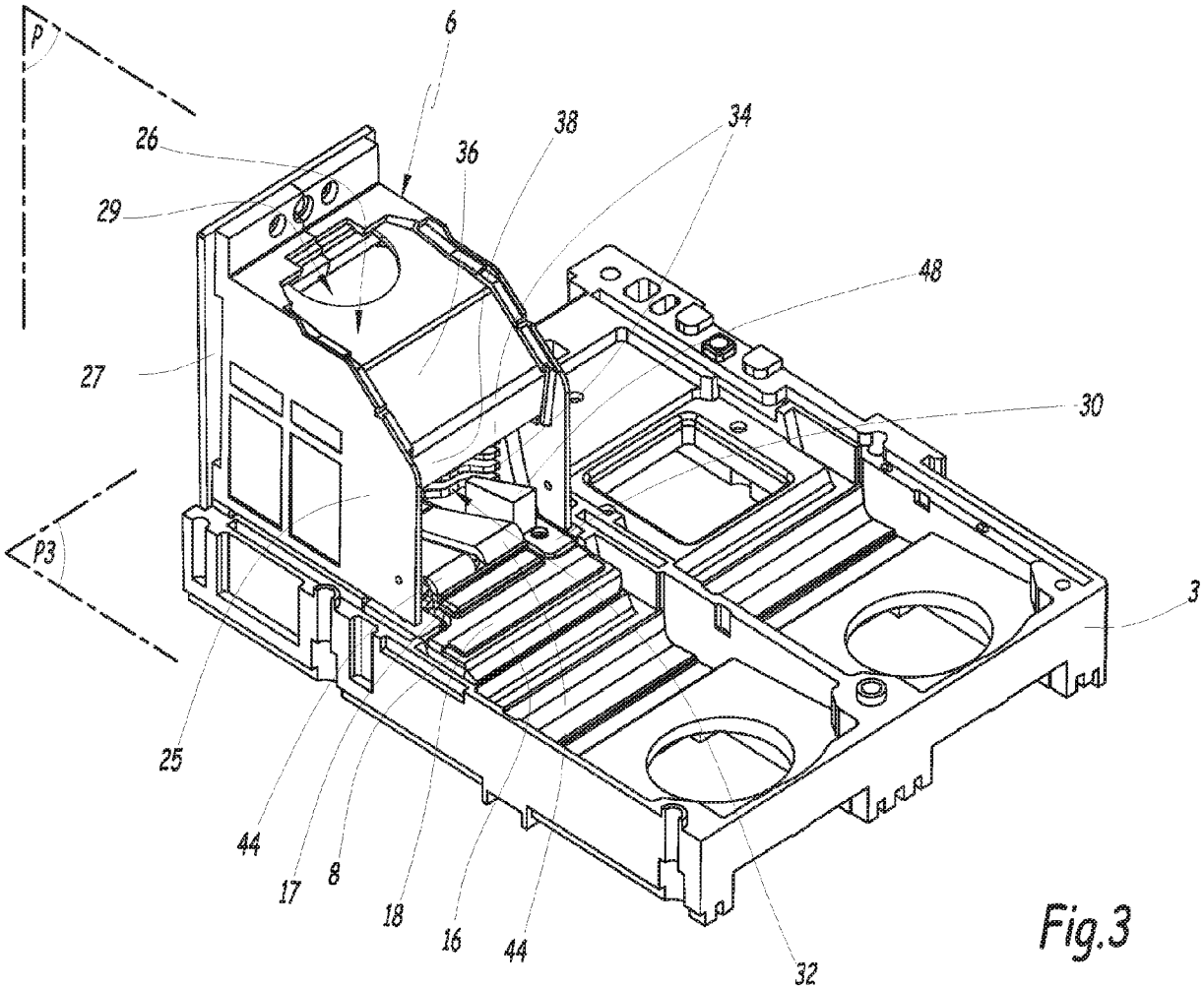
FIG. 3 is a perspective and partial view of an arc-extinguishing chamber of the electrical circuit breaker of FIG. 1.
Figure 4:
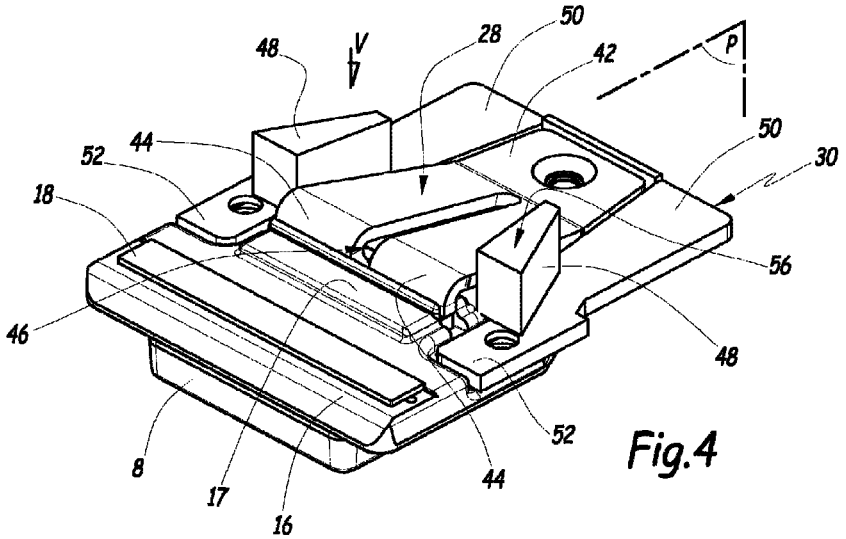
FIG. 4 is a perspective view of a bottom arc-guiding horn and of a screen made of insulating material of the arc-extinguishing chamber of FIG. 3.
Figure 5:
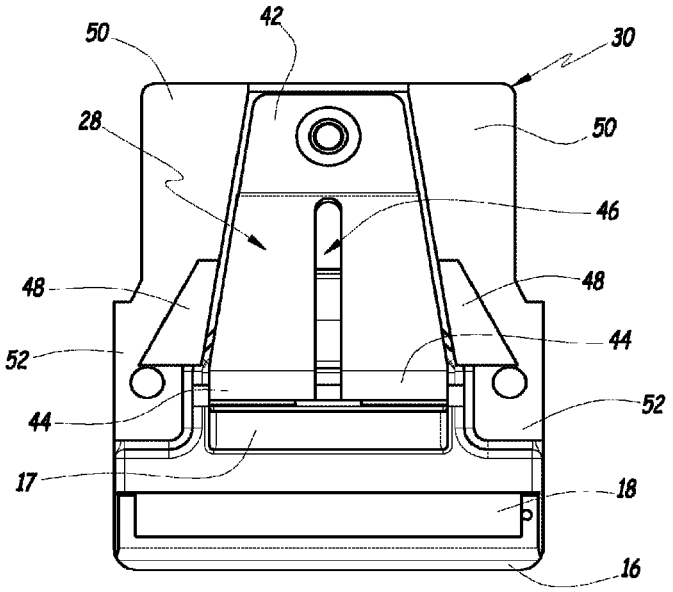
FIG. 5 is a view, according to the arrow V in FIG. 4, of the components of FIG. 4.
Figure 6:
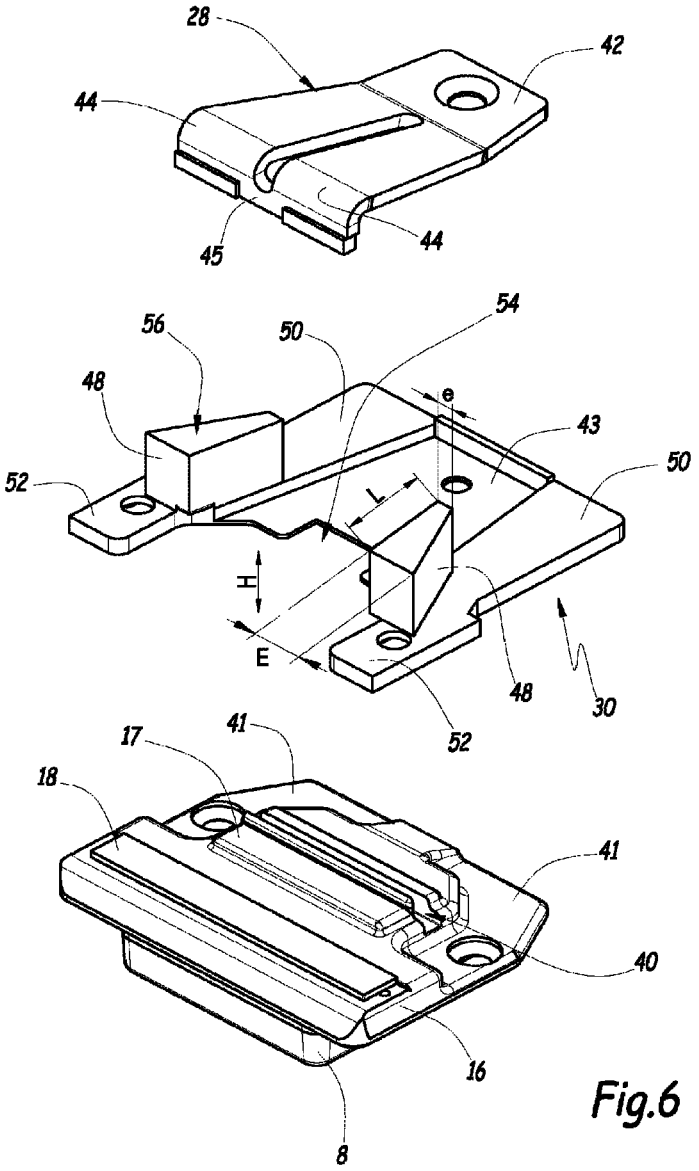
FIG. 6 is an exploded view of the elements represented in FIG. 4.

The main contact 16 of the electrical circuit breaker 1 is connected to the first contact region 8 of the casing 2 and comprises a first land 18, which is thus called fixed land. The first land 18 of the fixed main contact 16 is thus electrically connected to the first contact region 8. The first land 18 has a planar and elongate rectangular form, as can be seen in FIG. 3.

As a variant, the main contact 16 comprises a number of lands 18.

The main contact 16 also comprises an arc land 17. The arc land 17 is electrically connected to the first contact region 8 and thus to the first land 18. The arc land 17 is called fixed arc land. The arc land 17 has a rectangular and elongate form. Its length is, for example, less than the length of the land 18.

Finally, the main contact 16 comprises a recess 40 and two stages 41. The recess 40 extends parallel to the lands 17 and 18 opposite the land 18 relative to the land 17. The stages 41 are positioned on either side of the recess 40.

The support assembly 14 is made of insulating material. The assembly 14 defines a first axis X14 of rotation and is equipped with a plurality of mobile contacts 15.

The mobile contacts 15 are parallel and of equal length. In practice, the mobile contacts 15 extend transversely relative to the lands 17 and 18, in a direction at right angles to the axis X14. Each mobile contact 15 comprises an extension 21 and a second land 22. The extension 21 of each mobile contact 15 comprises an arc land 23. The arc lands 23 of the mobile contacts 15 are configured to cooperate with the fixed arc land 17.

In practice, the assembly 14 comprises a plurality of second lands 22, between 4 and 12 thereof, preferably 10.

As a variant, the assembly 14 comprises a single mobile contact 15.

The mobile contacts 15 of the assembly 14 are mobile, relative to the assembly 14 and about a second axis X15 parallel to the first axis X14, between a so-called low position, in which the mobile contacts 15 are close to the fixed main contact 16, and a so-called high position in which the mobile contacts 15 are separated from the fixed main contact 16.

The spring device of the mechanism 12 bears on the mobile contacts 15 and is thus configured to stress the mobile contacts 15 in rotation about the axis X15 in the anti-clockwise direction in FIG. 1.

The support assembly 14 also comprises an internal electrical connection, which is not represented in the figures and which is configured to electrically link the lands 22 and 23 of the mobile contacts 15 to the second contact region 10 of the circuit breaker 1.

The assembly 14, and thus the mobile contacts 15, are mobile relative to the casing 2 and in rotation, about the axis of rotation X14, between the first position of closure in which the second lands 22 are in contact with the first land 18 and the second position of opening in which the second lands 22 are separated from the first land 18. Thus, the arc lands 23 and the second lands 22 are said to be mobile.

In particular, the assembly 14 and the mobile contacts 15 are arranged in such a way that the rotations about the respective axes X14 and X15 have reverse directions. For example, when the assembly 14 passes from the position of closure to the position of opening, the assembly 14 is rotated about the axis X14 in the clockwise direction, whereas the mobile contacts 15 pass from the high position to the low position and are rotated about the axis X15 in the anti-clockwise direction.

The arc-extinguishing chamber 6 is configured to absorb an electrical energy generated by an electrical arc which is generated between the first land 18 and the second lands 22 when the mobile contacts 15 are displaced from their first position to their second position, that is to say when the second lands 22 are separated from the first land 18. In practice, the extinguishing chamber 6 is configured to provoke, first of all, the elongation and, in succession, the breaking up and extinguishing of the electrical arc.

The extinguishing chamber 6 comprises a stacking of plates 24, a top horn 26, a bottom horn 28 and a screen 30 made of insulating material. The chamber 6 further comprises two lateral walls 25 and a bottom wall 27. The walls 25 and 27 define, using the horns 26 and 28 and the screen 30, a cage of the chamber 6. P denotes the central plane of the extinguishing chamber 6, which is at right angles to the plane P3 of the base 3 of the casing 2. The plane P thus defines a central main plane for the circuit breaker 1.

The bottom wall 27 is provided with a porous filtering system which makes it possible to cool a gas present in the chamber 6. The cooling of the gas makes it possible to maintain a correct pressure inside the chamber 6 and thus avoid an overpressure, which could reduce the switching efficiency of the extinguishing chamber 6. As a variant, the bottom wall 27 has no filtering system. The plates 24 are metal and are configured to provoke the de-ionization of the electrical arc, when the latter is present in the extinguishing chamber 6. Each plate 24 of the chamber 6 comprises a V-shaped central notch 32 arranged between two intermediate electrical arc collection edges 34. The edges 34 are symmetrical relative to the plane P of the chamber 6 and can be rectilinear or dished. In practice, the plane P of the chamber 6 passes through the notches 32 of the plates 24.

The top 26 and bottom 28 horns are made of steel and configured to guide the electrical arc from its original position between the first land 18 and the second lands 22 towards the interior of the extinguishing chamber 6.

The top horn 26 comprises a bent portion 36. The portion 36 is equipped with a tab 38 which is folded back downwards in a direction substantially at right angles to the plane P3 of the base 3 of the casing 2. The tab 38 of the top horn 26 is arranged transversely to the plates 24. The top horn 26 is provided with an orifice 29 allowing for the evacuation of an ionized gas generated in the chamber 6 during the stopping of the short-circuit currents. The discharging of the gas through this orifice 29 makes it possible to facilitate the regeneration of a gaseous medium between the mobile contacts 15 and the fixed contact 16. The discharging of the gas also makes it possible to maintain a correct pressure inside the chamber 6 and thus avoid an overpressure, which could reduce the switching efficiency of the extinguishing chamber 6. As a variant, the top horn 26 is provided with a number of discharge orifices.

The bottom horn 28 extends between the fixed main contact 16, which is attached to the first land 8, and the extinguishing chamber 6. In practice, the bottom horn 28 is electrically linked with the fixed main contact 16. The bottom horn 28 constitutes one of the end plates 24 of the extinguishing chamber 6 and comprises a tongue 42 and two tabs 44 arranged on either side of a notch 46.

The tongue 42 of the bottom horn 20 is positioned in a housing 43 of the screen made of insulating material 30. In practice, the tab 42 is surrounded by and secured to the screen 30 and is located inside the extinguishing chamber 6.

The tabs 44 are parallel to one another and extend, in a direction parallel to the plane P3, between the fixed arc land 17 of the fixed main contact 16 and the tongue 42. In particular, they protrude, in a direction at right angles to the plane P3, towards the top horn 26. In the assembled configuration of the circuit breaker 1, an edge 45 of the tabs 44 is arranged in the recess 40 of the fixed main contact 16. The tabs 44 are symmetrical relative to the central plane P of the chamber 6. The notch 46 faces the fixed arc land 17 of the main contact 16 and of the mobile contacts 15 of the electrical circuit breaker 1.

As a variant, the bottom horn 28 comprises a single tab 44.

The screen made of insulating material 30 is configured to electrically insulate the base 3 of the casing 2 from the extinguishing chamber 6. The screen 30 comprises the housing 43 and two planar portions 50. The planar portions are situated on either side of the housing 43 and each comprise an end 52. The ends 52 define, between them, an opening 54. The opening 54 is provided to receive the main contact 16. In practice, in the assembled configuration of the circuit breaker 1, the main contact 16 is arranged in the opening 54 of the screen 30, the ends 52 of the screen 30 being arranged on the stages 41 of the main contact 16.

Two protuberances 48 are mounted on the planar portions 50 of the screen 30, on either side of the housing 43 and of the opening 54, in which the main contact 16 is arranged.

As a variant, the circuit breaker 1 comprises a single protuberance 48.

The protuberances 48 form an integral part of the screen 30.

The protuberances 48 are produced in a gas-producing material. Gas-producing should be understood to mean that the material is capable of generating a gas when it is subjected to a certain temperature. In practice, the protuberances 48 are configured to generate a cooling gas, such as hydrogen, when their surfaces are subjected to a very high temperature, notably of the order of 800° C. The gas-producing material of the protuberances 48 is, for example, synthetic, notably of polyamide, of type 66, with between 10% and 30% glass fibre filling.

Thus, in the assembled configuration of the circuit breaker 1, the protuberances 48 are arranged at the input of the extinguishing chamber 6, between the bottom horn 28 and the top horn 26, and facing the lips 44 of the bottom horn 28. In practice, the protuberances 48 are arranged, in a direction parallel to the axis X14, on either side of the tabs 44 of the bottom horn 28. Furthermore, the protuberances 48 are symmetrical relative to the central plane P of the extinguishing chamber 6.

The protuberances 48 have a prismatic or pseudo-prismatic form. In particular, 56 denotes the base of the prism forming a protuberance 48. The base 56 is, for example, of trapezoidal form.

H denotes the height of the protuberances 48. The height H is between 12 and 30 mm, preferably equal to 18 mm.

Also, L denotes the width of the protuberances 48. The width L is between 18 and 30 mm, preferably equal to 28 mm.

Finally, E denotes the maximum thickness and $_e$ denotes the minimum thickness of the protuberances 48. The maximum thickness E is between 3 and 13 mm, preferably equal to 11 mm, whereas the minimum thickness $_e$ is between 0 and 5 mm, preferably equal to 3 mm.

The operation of the circuit breaker 1 is as follows:

When the circuit breaker 1 is in the closed configuration, the support assembly 14 is in the position of closure and ensures the passing of an electrical current. The mobile contacts 15 are in the high position. The mobile lands 22 of the mobile contacts 15 are bearing against the land 18 of the fixed main contact 16. The pressure of the mobile lands 22 on the land 18 is ensured by the spring device of the mechanism 12. The arc lands 23 of the mobile contacts 15 are separated from the fixed arc land 17 of the fixed main contact 16. A non-zero distance, defined at right angles to the axis X14, exists between the arc lands 17 and 23. Thus, the electrical current passes exclusively between the lands 18 and 22.

When the electromagnetic actuator or the mechanical actuator of the circuit breaker 1 commands the electrical circuit to open, the support assembly 14 is rotated, about the axis X14, from the first position of closure towards the second position of opening of the lands 18 and 22. Furthermore, the mobile contacts 15 are rotated, about the axis X15, from the high position towards the low position. In practice, the respective rotations of the assembly 14 and of the mobile contacts 15 are in opposite directions. Because of these opposing rotations, before the mobile lands 22 of the mobile contacts 15 can be separated from the fixed land 18 of the main contact 16, the arc lands 23 of the contacts 15 come to bear on the fixed arc land 17 of the main contact 16. The distance that exists between the lands 17 and 23 in the position of closure of the assembly 14 is cancelled.

When the support assembly 14 continues its rotation towards the position of opening and the mobile lands 22 of the mobile contacts 15 are separated from the fixed land 18 of the main contact 16, the arc lands 17 and 23 still bear on one another. In practice, the opening of the lands 18 and 22 is performed without the generation of an electrical arc and the electrical current passes through the lands 17 and 23.

Finally, in the continuation of the rotation of the support assembly 14, the arc lands 17 and 23 separate and an electrical arc is generated between the latter. Thus, the presence of the arc lands 17 and 23 avoids the erosion of the main lands 18 and 22.

The form of the fixed arc land 17 makes it possible to obtain a centring of the arc relative to the central plane P of the chamber 6. This reduces the wear of the lateral walls 25 of the chamber 6 and the result thereof is a notable improvement in the electrical endurance of the circuit breaker 1.

Because of the proximity of the tabs 44 of the bottom horn 28 to the fixed arc land 17, the electrical arc is forced to migrate towards the bottom horn 28. In particular, the electrical arc is set up between the lip 45 of the bottom horn 28 and the tab 32 of the top horn 26.

As is known per se, the form of the bottom 28 and top 26 horns guides the electrical arc towards the interior of the extinguishing chamber 6. The electrical energy associated with the electrical arc is dissipated as heat and provokes a very significant increase in the temperature which reaches, for example, 4000° C. at the core of the electrical arc. Such a temperature provokes the vaporization of the surfaces of the protuberances 48 and thus the production of the cooling gas. The cooling action of the electrical arc produced by the gas produced by the protuberances 48 is thus improved.

The gas generated by the protuberances 48 is then discharged through the discharge orifice positioned on the top horn 26 of the extinguishing chamber 6.

The embodiment and the variants envisaged above can be combined together to generate new embodiments of the invention.

The invention claimed is:

1. An electrical circuit breaker comprising:

at least one first fixed land;

a support assembly equipped with at least one second land and rotationally mobile, about a main axis, between a first position in which the second land is in contact with the first land and a second position in which the second land is separated from the first land; and an arc-extinguishing chamber comprising:

a stacking of plates;

a top arc-guiding horn;

a bottom arc-guiding horn, equipped with at least one tab; and a screen made of insulating material surrounding the bottom arc-guiding horn, the circuit breaker comprising two protuberances produced in a gas-producing material, which are mounted on the screen, arranged between the bottom arc-guiding horn and the top arc-guiding horn and facing the tab of the bottom arc-guiding horn, the protuberances having a prismatic or pseudo-prismatic form.

2. The circuit breaker according to claim 1, wherein the bottom arc-guiding horn is equipped with two parallel tabs forming an edge and in that the protuberances are arranged on either side of the tabs of the bottom arc-guiding horn.

3. The circuit breaker according to claim 2, wherein the protuberances are symmetrical relative to a central plane of the extension chamber.

4. The circuit breaker according to claim 1, wherein one protuberance has:

a height of between 12 and 30 mm, preferably equal to 18 mm, a width of between 18 and 30 mm, preferably equal to 28 mm, and a maximum thickness of between 3 and 13 mm, preferably equal to 11 mm.

5. The circuit breaker according to claim 4, wherein one protuberance has a minimum thickness ($_e$) of between 0 and 5 mm, preferably equal to 3 mm.

6. The circuit breaker according to claim 1, wherein the gas-producing material of at least one protuberance is synthetic, notably a glass fibre-filled polyamide, of type 66.

7. The circuit breaker according to claim 1, wherein the top arc-guiding horn comprises at least one orifice for discharging a gas generated by at least one protuberance.

8. The circuit breaker according to claim 1, wherein the support assembly comprises a plurality of second lands, between 4 and 12 thereof, preferably 10.

9. The circuit breaker according to claim 1, wherein the top and bottom arc-guiding horns are made of steel.

10. The circuit breaker according to claim 1, wherein the protuberances form an integral part of the screen.

* * * * *